US005734134A

United States Patent [19]

Park

[11] Patent Number: 5,734,134

[45] Date of Patent: Mar. 31, 1998

[54] SUCTION NOISE MUFFLER FOR HERMETIC COMPRESSOR HAVING RESIDUAL OIL DISCHARGING VALVE

[75] Inventor: Dong Ju Park, Kyungsangnam-Do, Rep. of Korea

[73] Assignee: L. G. Electronics Inc., Seoul, Rep. of Korea

[21] Appl. No.: 689,505

[22] Filed: Aug. 12, 1996

[30] Foreign Application Priority Data

Aug. 17, 1995 [KR] Rep. of Korea ..... 21163/1995

[51] Int. Cl.[6] ..... F02M 35/00; F01N 1/10

[52] U.S. Cl. ..... 181/229; 181/237; 181/403

[58] Field of Search ..... 181/229, 237, 181/403

[56] References Cited

U.S. PATENT DOCUMENTS

| | | | |
|---|---|---|---|
| 3,129,784 | 4/1964 | Smallpeice | 181/237 |
| 4,179,883 | 12/1979 | Nishiyama et al. | 181/237 |
| 4,582,468 | 4/1986 | Bar | 181/403 |
| 4,730,695 | 3/1988 | Bar | 181/252 |
| 4,900,234 | 2/1990 | Schrank et al. | 417/312 |
| 5,252,035 | 10/1993 | Lee | 181/403 |
| 5,263,643 | 11/1993 | Wells et al. | 236/48 R |

*Primary Examiner*—Eddie C. Lee

*Attorney, Agent, or Firm*—Ostrolenk, Faber, Gerb & Soffen, LLP

[57] ABSTRACT

An improved suction noise muffler for a hermetic compressor which is capable of discharging residual oil which is introduced together with a refrigerant gas using the weight of the oil itself by equipping with an oil discharging valve unit at an oil discharging unit, which muffler includes a guide path for guiding a refrigerant gas introduced through an inlet portion along a connected path, resonant and noise reducing chambers formed for reducing noise of the refrigerant gas which flows along the guide path, and an oil discharging section having an upper discharging section in order for the oil introduced into the resonant and noise reducing chambers together with refrigerant gas to be discharged through the discharging valve unit operated by the weight of the oil, with the oil discharging valve unit being formed in the upper discharging section.

4 Claims, 5 Drawing Sheets

SUCTION NOISE MUFFLER FOR HERMETIC COMPRESSOR HAVING RESIDUAL OIL DISCHARGING VALVE

BACKGROUND OF THE INVENTION

1. Field of the Invention

The present invention relates to a suction noise muffler for a hermetic compressor, and particularly to an improved suction noise muffler for a hermetic compressor which is capable of more efficiently discharging an oil introduced together with a refrigerant gas using gravity by providing an oil discharging valve unit arranged in an oil discharging section.

2. Description of the Conventional Art

As shown in FIGS. 1 through 4, a conventional hermetic compressor includes a housing 1 containing a motor unit 2 including a stator 2*a* and a rotor 2*b* within the housing 1, with one end of a crank shaft 3 being fixedly inserted into the rotor 2*b*, and an eccentric section 4 being formed at the other end of the crank shaft 3. A cylinder 5 is disposed at one side of the eccentric section 4, and a piston 6 connected to one end of the cylinder 5 reciprocates within the cylinder 5.

A valve plate 7 is disposed at the other end of the cylinder 5. A suction noise muffler 8 is provided to a portion of a head cover 9, with the head cover 9 being disposed on the valve plate 7.

In particular, as shown in FIG. 3, the conventional suction noise muffler 8 includes an inlet portion 8*a* through which a refrigerant gas is introduced, and a guide path 8*b* for guiding the refrigerant gas which is introduced thereto through the inlet portion 8*a*.

A resonant chamber 8*d* is formed in one side of the guide path 8*b* so as to reduce the noise of the refrigerant gas introduced thereinto, and a noise reducing chamber 8*e* is formed above the resonant chamber 8*d* and communicates with the inlet portion 8*a* through a resonant hole 8*c* for reducing the noise of the refrigerant gas.

An outlet portion 8*f* is formed in the other side of the suction noise muffler 8 for discharging the refrigerant gas therethrough.

FIG. 4 shows a suction noise muffler 8' in accordance with another embodiment of the conventional hermetic compressor, which is directed to overcoming the problems of the suction noise muffler 8 shown in FIG. 3.

In particular, an upper discharging hole 8*g* is formed in a wall 8*i* arranged between the resonant chamber 8*d* and the noise reducing chamber 8*e*, and a lower discharging hole 8*h* is formed below the resonant hole 8*c* in the wall arranged between the resonant chamber 8*d* and the guide path 8*b*.

The conventional hermetic compressor will now be explained in more detail.

First, when current is applied to the motor unit 2, the rotor 2*b* of the motor unit 2 is rotated. Here, as the crank shaft 3 inserted into the rotor 2*b* is rotated, the eccentric section 4 is rotated, and the piston 6 reciprocates within the cylinder 5.

The suction force generated by the piston 6 and the cylinder 5 draws the refrigerant gas and oil into the suction noise muffler 8. This suction process will now be explained in detail.

The suction muffler 8 shown in FIG. 3 will be first explained.

The refrigerant gas introduced into the inlet portion 8*a* flows along the guide path 8*b*, and the refrigerant gas flows into the resonant chamber 8*d* and the noise reducing chamber 8*e*, respectively, and thereafter the gas is introduced into the cylinder 5 through the discharging hole 8*f*.

However, the residual oil remaining after the refrigerant gas is discharged through the discharging hole 8*f* remains at the bottom of the resonant chamber 8*d* and the noise reducing chamber 8*e*. Since the thusly remaining oil is not easily discharged, the volummes of the resonant chamber 8*d* and the noise reducing chamber 8*e* are reduced, thus degrading the efficiency of reducing the noise.

In order to overcome the above-mentioned problems, another suction noise muffler 8 was introduced in the industry as shown in FIG. 4. The operation of this muffler 8' will now be explained.

First, the refrigerant gas introduced into the introducing section 8*a* flows along the guide path 8*b*, and is guided into the resonant chamber 8*d* and the noise reducing chamber 8*e*. Here, the oil flows into the resonant chamber 8*d* and the noise reducing chamber 8*e* together with the refrigerant gas. Thereafter, the refrigerant gas is introduced into the cylinder 5 through the discharging hole 8*f*.

The residual oil remaining in the resonant chamber 8*d* and the noise reducing chamber 8*e* after the refrigerant gas is discharged through the discharging hole 8*f* is discharged through the upper discharging hole 8*g* and the lower discharging hole 8*h*.

However, since the upper and lower discharging holes 8*g* and 8*h* are always open, it is impossible to achieve a desired noise reducing effect.

SUMMARY OF THE INVENTION

Accordingly, it is an object of the present invention to provide a suction noise muffler for a hermetic compressor, which overcomes the problems encountered in a conventional suction muffler for a hermetic compressor.

It is another object of the present invention to provide an improved suction noise muffler for a hermetic compressor which is capable of discharging an oil which is introduced together with a refrigerant gas by using gravity itself by equipping with a refrigerant gas discharging unit in an oil discharging unit.

To achieve the above objects, there is provided a suction noise muffler for a hermetic compressor, which includes a guide path for guiding a refrigerant gas introduced through an inlet portion to a connected path; resonant and noise reducing chambers formed for reducing noise of the refrigerant gas which flows along the guide path; and an oil discharging section having an upper discharging section in order for oil introduced into the resonant and noise reducing chambers together with the refrigerant gas to be discharged by gravity acting upon the weight of the oil, with an oil discharging unit being formed in the upper discharging section.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 5A through 5C are views showing a suction noise muffler for a hermetic compressor according to a first embodiment of the present invention, in which:

FIG. 5A is a partial cross-sectional view of the suction noise muffler;

FIG. 5B is a perspective view of an oil discharging unit; and

FIG. 5C is a perspective view showing an operation state of the oil discharging unit;

FIGS. 6A and 6B are views of an oil discharging unit of a suction noise muffler according to a second embodiment of the present invention, in which:

FIG. 6A is a cross-sectional view of the oil discharging unit; and

FIG. 6B is a perspective view showing an operation state of the oil discharging unit;

DETAILED DESCRIPTION OF THE INVENTION

Figure 1:
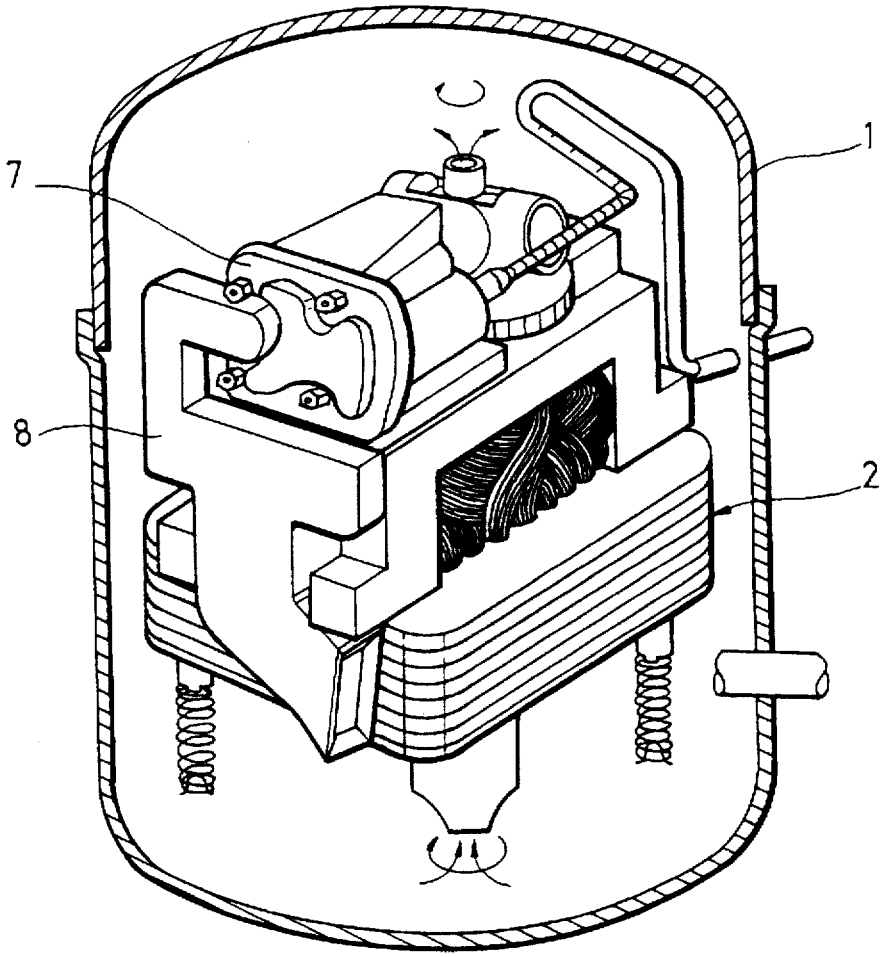
FIG. 1 CONVENTIONAL ART
FIG. 1 is a perspective cut-away view of a conventional hermetic compressor.
Figure 2:
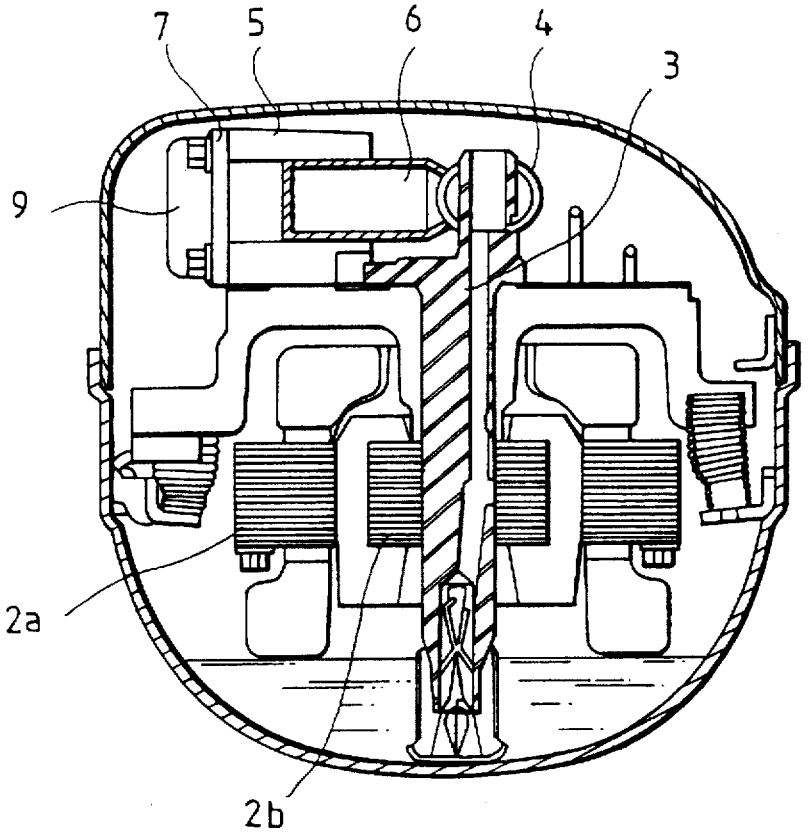
FIG. 2 CONVENTIONAL ART
FIG. 2 is a cross-sectional view of the hermetic compression in FIG. 1.
Figure 3:
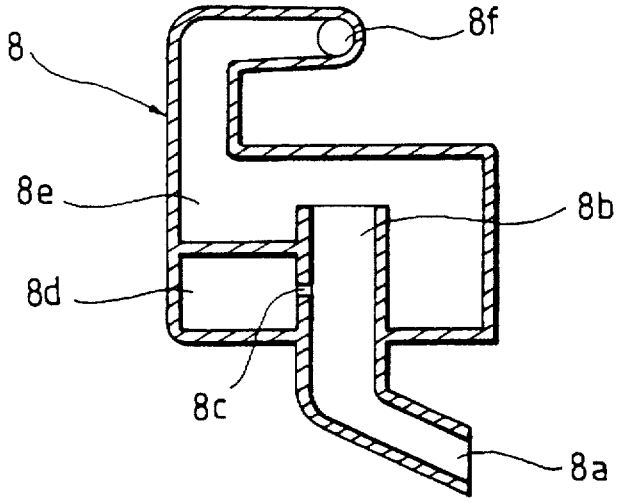
FIG. 3 CONVENTIONAL ART
FIG. 3 is a cross-sectional view of one example of a conventional suction noise muffler.
Figure 4:
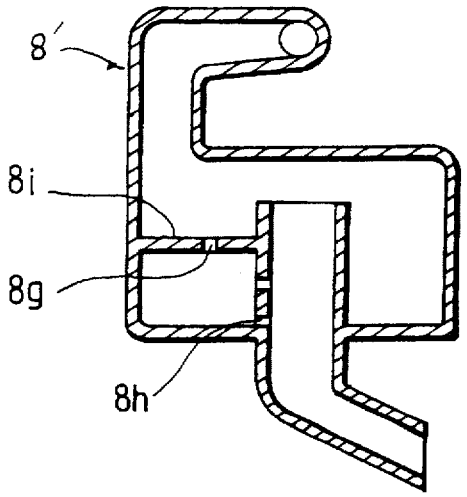
FIG. 4 CONVENTIONAL ART
FIG. 4 is a cross-sectional view of another example of a conventional suction noise muffler.

FIG. 5 shows a suction noise muffler 80 for a hermetic compressor according to the present invention, which includes an inlet section 81, formed at one side thereof, through which a refrigerant gas is introduced, and an outlet section (not shown), formed in the other side thereof, through which the refrigerant gas, which is introduced therein through the inlet section 81, is discharged.

A guiding path 82 is formed between the inlet section 81 and the outlet section (not shown) for guiding the refrigerant gas therethrough.

A resonant chamber 84 is formed at one side of the guiding path 82 for reducing the vibration noise in a specific frequency band of the refrigerant gas introduced thereinto through a resonant hole 83, and a noise reducing chamber 85 is formed at the other side of the guiding path 82 and above the resonant chamber 84 for reducing the vibration noise in a specific frequency band of the refrigerant gas.

An upper oil discharging port 87 is formed in a wall 86 formed between the resonant chamber 84 and the noise reducing chamber 85, with the oil at the bottom flowing to the noise reducing chamber 85 being discharged through the upper oil discharging port 87, and a lower oil discharging port 88 is formed in a lowermost portion of a wall formed between the guiding path 82 and the resonant chamber 84, with the oil collecting at the bottom of the resonant chamber 84 being discharged through the lower oil discharging port 88.

In particular, an oil discharging valve 60 is disposed at the upper oil discharging port 87, with the oil discharging valve being opened/closed by the weight of the oil.

Figure 5A:
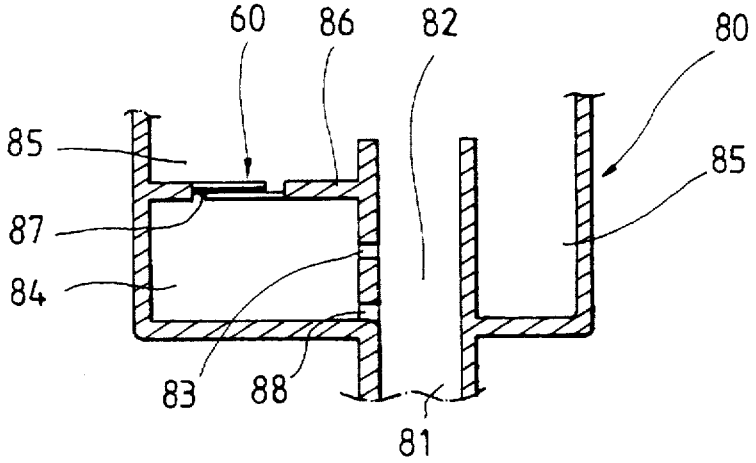
Figure 5B:
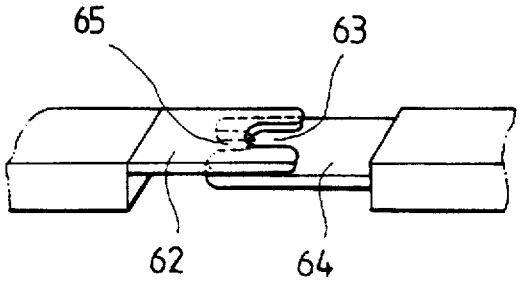
Figure 5C:
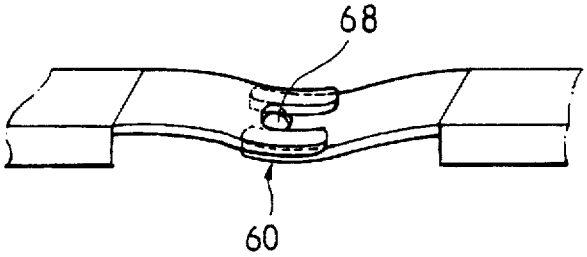

Here, the oil discharging valve 60 may be formed in various shapes, among which, as shown in FIGS. 5A through 5C, the oil discharging valve 60 of the suction noise muffler 80 according to a first embodiment of the present invention includes an upper plate 62 and a lower plate 64 which are made of an elastic material.

One end of the upper plate 62 is connected to the upper discharging section 87, and a U-shaped (bifurcated) first opening 63 is formed at the other end thereof.

On end of the lower plate 64 is fixed to the wall 86, with the other end being partially overlapping with the upper plate 62. A u-shaped second opening 65 is formed at the other end thereof. In this state, when a predetermined force is applied to the upper plate 62 and/or the lower plate 64, the overlapped portion between the upper and lower plates 62 and 64 is upwardly or downwardly extended, thus forming an opening 68 between the U-shaped first and second openings 63 and 65, through which the oil can flow.

Figure 6A:
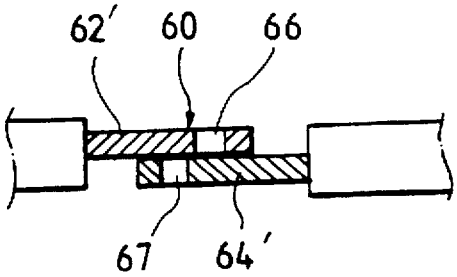
Figure 6B:
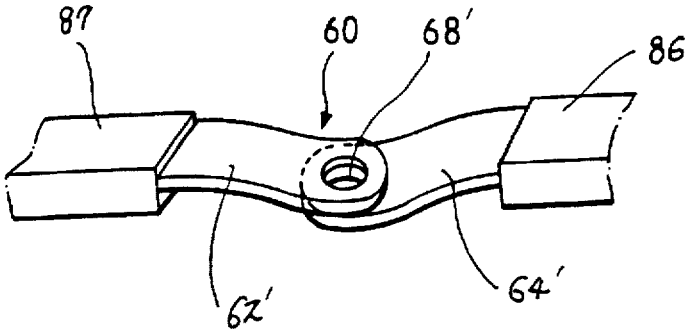

In addition, FIG. 6 shows a second embodiment of the present invention which includes an oil discharging unit 60' of the suction noise muffler 80, with the oil discharging valve 60' including an upper plate 62' and a lower plate 64' which are made of an elastic material.

One end of the upper plate 62' is fixed to the upper discharging section 87, with the other end thereof being formed with a first hole 66.

In addition, one end of the lower plate 64' is fixed to the wall 86, with the other end thereof being formed with a second hole 67, and with the first and second holes 66 and 67 in cooperative alignment forming an oil discharging port 68 therebetween when a predetermined force is applied thereto. Here, the upper and lower plates 62' and 64' are partially overlapped. In more detail, the size of the oil discharging port 68 varies in accordance with the level of the force applied thereto. In this embodiment, the weight of the oil is applied thereto.

Figure 7:
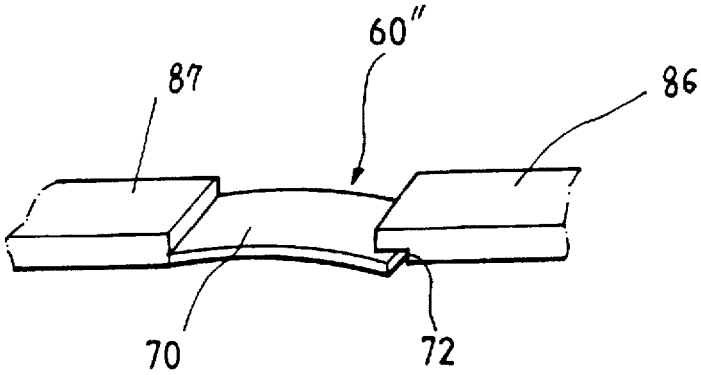
FIG. 7 is a perspective view showing an oil discharging unit of a suction noise muffler according to a third embodiment of the present invention.

FIG. 7 shows a third embodiment according to the present invention, which includes an oil discharging valve 60" having an elastic oil discharging plate 70, with one end of the oil discharging plate 70 being fixed to the upper discharging section 87, and with the other end thereof contacting with a shoulder recess 72 which is downwardly opened at the end of the wall 86. Here, when a predetermined force is applied to the oil discharging valve 60", the oil discharging plate 70 is downwardly extended, thus forming a gap between the edge of the oil discharging plate 70 and the shoulder recess 72 in the wall 86, through which the oil can flow.

The operation of the suction noise muffler for a hermetic compressor according to the present invention will now be explained with reference to the accompanying drawings.

First, when the rotor (not shown) is rotated, the crank shaft (not shown) fixedly connected to the rotor is rotated thereby, and the piston (not shown) reciprocates within the cylinder (not shown).

Here, a suction force is generated by the movement of the piston and the cylinder in the system. The refrigerant gas and oil are sucked into the suction noise muffler 80 under the influence of such a suction force. Thereafter, the refrigerant gas is introduced into the cylinder, and a portion of oil remains on the upper surface of the upper and lower plates 62 and 64 of the noise reducing chamber 85.

If a predetermined amount of the oil collects on the upper surface of the upper and lower plates 62 and 64, the upper and lower plates 62 and 84 are downwardly extended by the weight of the collected oil. As shown in FIG. 5C, when the amount of the collected oil exceeds a predetermined level, the oil discharging hole 68 is formed between the first and second openings 63 and 65.

After the oil is discharged through the oil discharging hole 68, the upper and lower plates 62 and 64 return to their initial shapes due to their recovering force.

Next, the operation of the third embodiment of the present invention will now be explained.

When a predetermined amount of oil collects on the upper surface of the oil discharging plate, the end of the oil discharging plate 70 contacting with the wall 86 is deflected downwardly and looses contact with the wall 86, thus forming a gap between the edge of the oil discharging plate 70 and the recess 72, with the oil being discharged through the gap formed therebetween. After the oil is discharged therethrough, the edge of the oil discharging plate 70 raises again until it comes into contact with the recess 72.

Namely, the present invention is advantageous in easily discharging the residual oil by providing the oil discharging valve 60 which is opened and closed by the weight of the residual oil. In addition, it is possible to maintain a sealed state and a desired volume in the resonant chamber 84 and the noise reducing chamber 85 for a prolonged time, thus effectively reducing noise in the system.

Moreover, the present invention is capable of properly adjusting the amount of the residual oil and the discharging amount of the oil.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A suction noise muffler for a hermetic compressor, comprising:

a guide path for guiding a refrigerant gas introduced through an inlet portion along a suction path;

resonant and noise reducing chambers formed for reducing noise of the refrigerant gas which flows along the guide path; and an oil discharge path having an upper discharging section for oil introduced into the resonant and noise reducing chambers together with the refrigerant gas to be discharged therethrough by the weight of the oil, an oil discharging valve means formed at the upper discharging section, the oil discharging valve means being constructed of an elastically deformable material which deforms due to weight of the oil in the chambers.

2. The muffler of claim 1, wherein said oil discharging valve means includes:

an upper plate, with one end thereof being fixed to one side of the upper discharging section, and with the other end thereof having a U-shaped first opening; and a lower plate having a U-shaped second opening formed at one end thereof, with the second opening being overlapped with the first opening, and with the other end of the lower plate being fixed to a wall formed between the resonant chamber and the noise reducing chamber, and with an oil discharging port being formed between the first and second openings through which the oil is discharged, wherein the port is opened/closed by the weight of the oil applied thereto.

3. The muffler of claim 1, wherein said oil discharging valve means includes:

an upper plate, with one end thereof being fixed to the upper discharging section, and with the other end thereof having a first hole; and a lower plate, with one end thereof being fixed to a wall formed between the resonant chamber and the noise reducing chamber, and with the other end thereof having a second hole, and with the first hole and the second hole contacting with each other, wherein when a predetermined force is applied to the oil discharging valve means, the upper and lower plates downwardly or upwardly extend, thus forming an oil discharging port between the upper plate and the lower plate, though which the oil may flow by gravity.

4. The muffler of claim 1, wherein said oil discharging valve means includes:

a recess being downwardly opened formed at an end of a wall formed between the resonant chamber and the noise reducing chamber; and an oil discharging plate, with one end thereof being fixed to the upper oil discharging section, and with the other end thereof contacting with the recess, wherein when a predetermined weight of oil is applied to the oil discharging plate, the oil discharging plate downwardly deflects to form a gap between the edge of the oil discharging plate and the recess, through which gap the oil may flow, and after the oil is discharged through aid gap, the edge of the oil discharging plate comes again into contact with the recess again.

* * * * *